US009278536B2

(12) United States Patent
Din et al.

(10) Patent No.: US 9,278,536 B2
(45) **Date of Patent: *Mar. 8, 2016**

(54) PRINTING HEAD MODULE

(71) Applicants: XYZprinting, Inc., New Taipei (TW); Kinpo Electronics, Inc., New Taipei (TW); Cal-Comp Electronics & Communications Company Limited, New Taipei (TW)

(72) Inventors: Shih-Jer Din, New Taipei (TW); Jui-Feng Chang, New Taipei (TW); Clyde Ventolina Cordero, Singapore (SG)

(73) Assignees: XYZprinting, Inc., New Taipei (TW); Kinpo Electronics, Inc., New Taipei (TW); Cal-Comp Electronics & Communications Company Limited, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/337,231

(22) Filed: Jul. 22, 2014

(65) Prior Publication Data

US 2016/0023467 A1 Jan. 28, 2016

(51) Int. Cl.
*B41J 2/165* (2006.01)

(52) U.S. Cl.
CPC ..... *B41J 2/16544* (2013.01)

(58) Field of Classification Search
None
See application file for complete search history.

(56) References Cited

U.S. PATENT DOCUMENTS 9,073,366 B1 * 7/2015 Din et al.
2008/0317894 A1 * 12/2008 Turley et al. ..... 425/226

* cited by examiner

*Primary Examiner* — Erica Lin
(74) *Attorney, Agent, or Firm* — Jianq Chyun IP Office

(57) ABSTRACT

A printing head module includes a bracket, a plurality of printing heads, a pivot shaft, a wiper unit, and a control unit. The bracket includes a plurality of through holes. The printing heads are parallelly aligned with each other, each of the printing heads a nozzle for extruding the modeling material. The pivot shaft connected to the bracket is adapted to rotate the printing heads to a target position. The wiper unit includes a holder, a plurality of wipers, and a wiper opener. The holder is connected to the pivot shaft to be rotated with the bracket and the printing heads. The wipers rotatably connected to the holder and disposed correspondingly to the openings. The wiper opener is disposed at the target position to interfere with the wiper rotated to the target position, so as to drive the corresponding wiper to rotate to the opening position.

10 Claims, 4 Drawing Sheets

PRINTING HEAD MODULE

BACKGROUND OF THE INVENTION

1. Technical Field

The technical field relates to a printing head module, and more particularly to a printing head module having a wiper unit.

2. Description of Related Art

With advancement in computer-aided manufacturing (CAM), a three dimensional printing technology (3-D printing technology) has been developed in the manufacturing industry, thereby rapidly fabricating products from an original design concept. The 3-D printing, in fact, is a general term of a series of rapid prototyping (RP) techniques, and the basic principle thereof, and the concept thereof is a laminate manufacturing, wherein a rapid prototyping machine is used to form cross-sectional shapes of a workpiece in the X-Y plane through scanning, shift intermittently at a layer thickness in the Z coordinates, and ultimately form 3-D objects. The 3-D printing technology is unrestrictedly applicable for the geometric shapes and the RP technology produces excellent outputs in particular for complex parts, which saves efforts and processing time significantly. As a result, the digital 3-D printing technology is capable of presenting an object of a digital 3-D model designed by means of computer-aided design (CAD) software under a shortest time requirement for the user to touch and actually feel the geometry of the model, or even to do possible functional test thereof.

When a printing head module is disposed with a plurality of printing heads, the printing heads are alternatively operated during the 3-D printing process. However, as the printing head is switched from one to another, often there is still residual modeling material left on the nozzle tips of the printing head which just finishes the printing task. Accordingly, the residual modeling material left on the nozzle tips of those printing heads might drop on the printing surface, which cause the contamination issues on the printing objects. Therefore, the printing quality of the 3-D printing process with multiple printing heads is decreased.

SUMMARY

The present disclosure is directed to a printing head module, wherein the printing head module includes the wiper unit for wiping the residual modeling material left on the nozzle tips of the printing heads and covering those nozzles of the printing heads when the printing heads are not in operation.

One of exemplary embodiments provides a printing head module configured to form a three-dimensional (3-D) object layer by layer with a modeling material on a carrying surface of a base. The printing head module includes a bracket, a plurality of printing heads, a pivot shaft, a wiper unit. The bracket includes a plurality of the through holes. The printing heads are parallelly aligned with each other and disposed in the through holes respectively, each of the printing heads comprising a nozzle for extruding the modeling material. The pivot shaft connected to the bracket is adapted to rotate the printing heads to a target position for dispensing the modeling material, the through holes disposed around the pivot shaft, such that the printing heads disposed therein surrounds the pivot shaft. The wiper unit includes a holder, a plurality of wipers, and a wiper opener. The holder connected to the pivot shaft to be rotated with the bracket and the printing heads. The holder includes a plurality of openings respectively located beneath and corresponding to the nozzles. The wipers are rotatably connected to the holder and disposed correspondingly to the openings. Each of the wipers adapted to rotate between an open position for exposing the corresponding opening and a block position for covering the corresponding opening. The wiper opener is disposed at the target position to interfere with the wiper rotated to the target position, so as to drive the corresponding wiper to rotate to the opening position for the corresponding printing head to extrude the modeling material through the opening, the wiper opener releasing the interference when the corresponding wiper passes the target position, so that the corresponding wiper rotate back to the blocking position to wipe off the residual modeling material from the tip of the nozzle.

Based on the aforementioned description, the wiper unit of the printing head module is correspondingly disposed underneath a plurality of printing heads, so as to wipe off and collect the residual modeling material left on the tips of the nozzles of the printing heads not in use, in order to avoid the residual modeling material dropping from the nozzle of the printing head not in use during the printing process. Therefore, with the configuration of the wiper unit, the residual modeling material left on the nozzle tips could be wiped off and collected, and the nozzle tips of the printing heads not in use could be covered to prevent the contamination of the surface of base and the printing objects, and so as to enhance the printing quality of the 3-D printing objects. Moreover, the processes of cleaning and maintenance of the nozzle tips could also be simplified due to the configuration of the wiper unit.

To make the above features and advantages of the disclosure more comprehensible, several embodiments accompanied with drawings are described in detail as follows.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
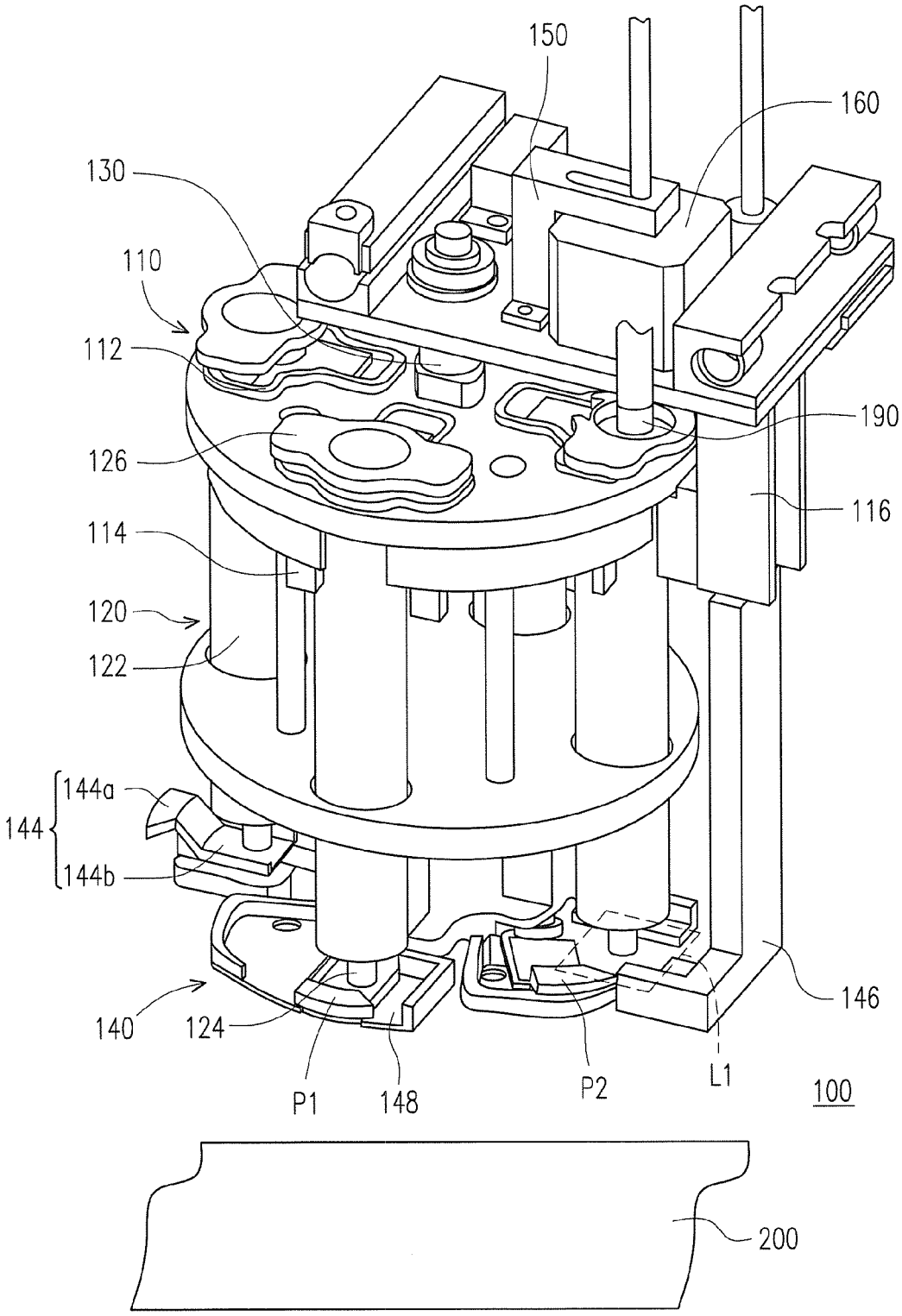
FIG. 1 a schematic view of the printing head module according to an exemplary embodiment.

It is to be understood that both of the foregoing and other detailed descriptions, features, and advantages are intended to be described more comprehensively by providing embodiments accompanied with figures hereinafter. In the following embodiments, wordings used to indicate directions, such as "up," "down," "front," "back," "left," and "right", merely refer to directions in the accompanying drawings. Therefore, the directional wording is used to illustrate rather than limit the exemplary embodiments. The present embodiment is approximately identical to the second embodiment, and same or similar reference numerals used in the present embodiment and in the second embodiment represent the same or similar elements.

FIG. 1 is a schematic view of printing head module according to an exemplary embodiment. Referring to FIG. 1, in the present embodiment, a printing head module 100 is applicable to a three-dimensional (3-D) printing apparatus for printing a 3-D object on the base 200 according to digital 3-D model information. The 3-D printing apparatus may include a printing head module 100 and a base 200. In the present embodiment, the 3-D printing apparatus is configured to read the digital 3-D model information. Therein, the digital 3-D model information may be a digital 3-D image file which is built by a computer host using, for example, a computer-aided design (CAD) or an animation modeling software.

Furthermore, the printing head module 100 is movably disposed above the base 200, and configured to slide back and forth along a sliding rail and the base 200 may also move relative to the printing head module 100. The 3-D printing apparatus is configured to read and process the digital 3-D model information, which controls the relative movements of the printing head module 100 to the base 200. Accordingly, the printing head module 100 may be moved along the sliding rail according to the digital 3-D model information, and the printing head module 100 is configured to dispense the modeling material layer-by-layer on the base 200 during the movement thereby forming a plurality of laminated material layers. The laminated material layers are stacked over one another to form the 3-D object.

Figure 2:
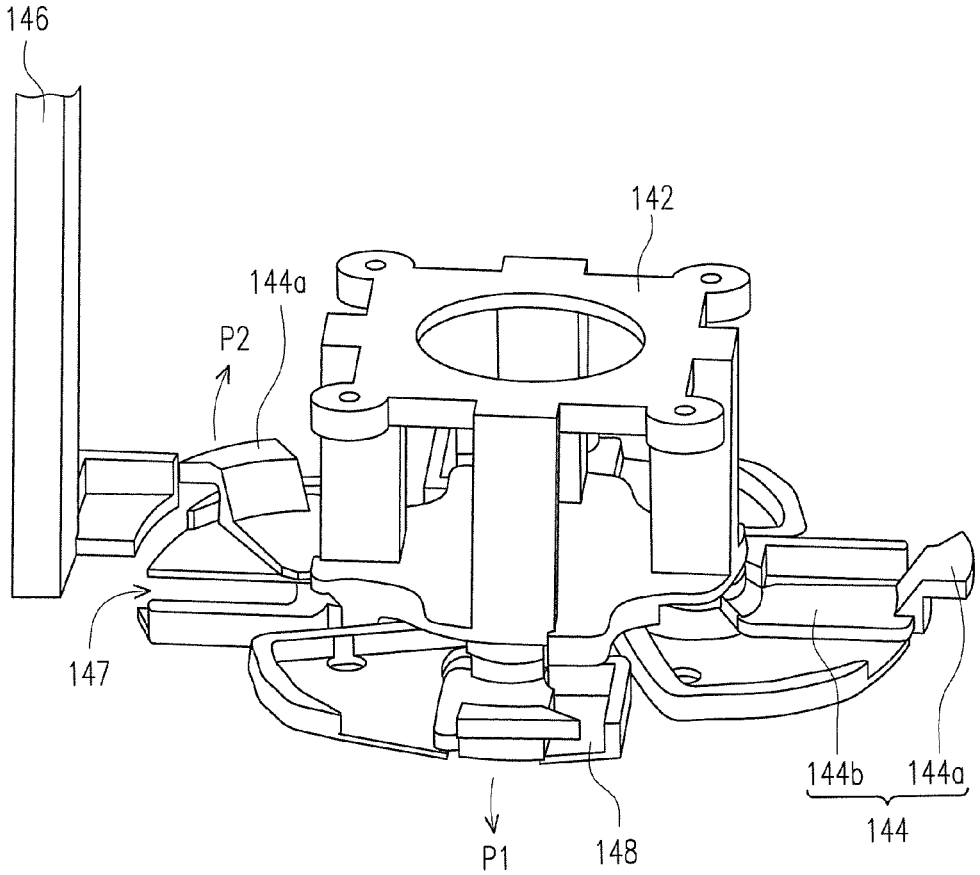
FIG. 2 is the schematic view of the wiper unit according to an exemplary embodiment.

FIG. 2 is the schematic view of the wiper unit according to an exemplary embodiment. Referring to FIG. 1 and FIG. 2, the printing head module 100 includes a bracket 110, a plurality of printing heads 120, a pivot shaft 130, a wiper unit 140, a wiper opener 146 and a control unit 160. The bracket 110 may include a plurality of through holes 112 corresponding to the printing heads 120 and a plurality of aligner holders 114. The printing heads are parallelly aligned with each other, and each of the printing heads may include a nozzle 124 for extruding the modeling material 30 therefrom. The pivot shaft 130 is connected to the bracket 110 and adapted to rotate one of the printing heads 120 to a target position L1 for dispensing the modeling material 30. The control unit 160 is coupled to the pivot shaft 130 for controlling the rotation of the bracket 110, so as to rotate one of the printing heads 120 to the target position L1. The wiper unit 140 includes the holder 142 and the wipers 144. The holder 142 is connected to the pivot shaft 130 to be rotated with the bracket 110 and printing heads 120. The holder 142 includes a plurality of openings 147 respectively located beneath and corresponding to the nozzles 124. The wipers 144 rotatably connected to the holder 142 and disposed correspondingly to the openings 147, and each of the wipers 144 is adapted to rotate between an opening position P2 for exposing the corresponding opening 147 as shown in FIG. 2 and a block position P1 for covering the corresponding opening 147. The printing head module 100 may further include a supporter 116. The supporter 116 is connected between the abovementioned sliding rail and the wiper opener 146 for supporting the wiper opener 146. The wiper opener 146 is disposed at the target position L1 through the supporter 116 for interfering with the wiper 144 rotated to the target position L1, so as to drive the corresponding wiper 144 to rotate to the opening position P2 for the corresponding printing head 120 to extrude the modeling material 30 through the opening 147. When the corresponding wiper 144 rotates till it passes the target position L1, the wiper opener 146 releases its interference with the corresponding wiper 144, so that the corresponding wiper 144 rotates back to the block position P1 to wipe off the residual modeling material 30 from the tip of the nozzle 124. The control unit 160 controls the pivot shaft 130 to rotate the bracket 110, so as to drive one of the printing heads 120 and the corresponding wiper 144 to be rotated to the target position L1.

Figure 3:
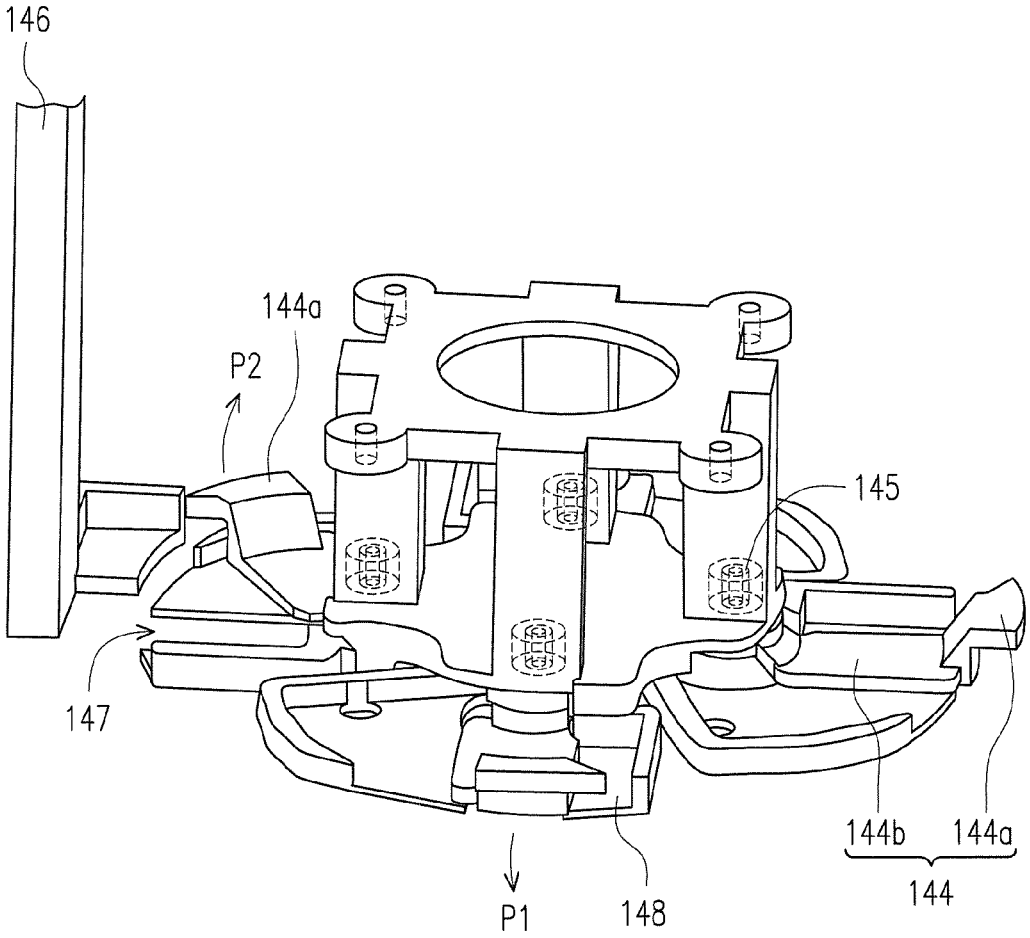
FIG. 3 illustrated the perspective view of the wiper unit of FIG. 2.

FIG. 3 illustrated the perspective view of the wiper unit of FIG. 2. Referring to FIG. 1 to FIG. 3, in the present embodiment, four printing heads 120 are illustrated in the present embodiment for extruding the modeling material 30. However, the present application does not limit the number of the printing heads of the printing head module. In the present embodiment, the printing head module 100 further includes a linear motor 150 and a plurality of torsion components 145. During the printing process, the modeling material 30 contained in the printing head 120 located at the target position L1 is extruded or squeezed out when the push-force is applied from the linear motor 150. The torsion components 145 are configured to respectively connect the wipers 144 to the holder 140. As such, the wiper 144 located underneath the aforementioned printing head 120 is rotated from the block position P1 to an opening position P2 to expose the corresponding opening 147 through the structural interference from the wiper opener 146 and the connection of the corresponding torsion component 145. Therefore, the modeling material 30 can be extruded through the exposed opening 147. In the present embodiment, the torsion components 145 are, for example, torsion springs.

After the printing task of the aforementioned printing head 120 is completed, the control unit 160 controls the pivot shaft 130 to rotate the bracket 110, so as to switch the next printing head 120 to the target position L1 for the following printing tasks. The wiper unit 140 disposed underneath the printing heads 120 and connected to the pivot shaft 130 through the holder 142 is correspondingly rotated. As such, when the wiper 144 corresponding to the previously-used printing head 120 is rotated till it passes the target position L1, the wiper opener 146 releases its interference with the corresponding wiper 144, so that the corresponding wiper 144 rotates back to the block position P1 to wipe off the residual modeling material 30 from the tip of the nozzle 124 of the previously-used printing head 120, and the nozzle 124 of the previously-used printing head 120 is covered by the corresponding wiper 144.

Specifically, each of the wipers 144 further includes an extension portion 144*a* and a flat portion 144*b* as shown in FIG. 2, and the holder 140 further includes a plurality of carrying portions 148 beneath and corresponding to the nozzles 124 for carrying the wiped-off residual modeling material 30, and the openings 147 are disposed on the carrying portions 148 respectively. The residual modeling material 30 on the tip of the nozzle 124 is wiped and collected by the flat portion 144*b* of the wiper 144, and thus the wiped-off residual modeling material 30 will be temporarily collected at the corresponding carrying portion 148. On the other hand, the wiper 144 underneath the printing head 120 rotated to the target position L1 is rotated to and constrained at the opening position P2 by the wiper opener 146, so as to expose the corresponding opening 147 for the modeling material 30 to be extruded therefrom and get ready for the following printing tasks. Specifically, the wiper opener 146 is adapted to interfere with the extension portions 144*a* of the wipers 144 to constrain the corresponding wiper 144 at the opening position P2.

In other words, when one of the printing heads 120 is rotated to the target position L1, the corresponding wiper 144 is rotated to the opening position P2 to expose the corresponding opening 147 by the wiper opener 146 located at the target position L1, such that the printing head 120 rotated to the target position L1 is suitable for extruding the modeling material 30 through the corresponding opening 147. When one of the printing heads 120 is rotated till it passes through the target position L1, the corresponding wiper 144 is back to the block position P1 for wiping off the residual modeling material 30 from the tip of the nozzle 124. In addition, the holder 142 may include a plurality of the carrying positions 148 disposed beneath and the openings 147 disposed on the carrying portions 148 respectively.

Referring back to FIG. 1, the bracket 110 may include a plurality of aligner holders 114. Each of the printing heads 120 further includes a leaning portion 126 and a cartridge 122. Each of the cartridges 122 for containing the modeling material 30 is connected to the corresponding nozzle 124. The aligner holders 114 are configured for detachably holding and locking the cartridges 122 of the printing heads 120 in the through holes 112 respectively. In addition, the aligner holder 114 may be composed of an elastic component or an elastic material. The configuration of the aligner holder 114 on the bracket 110 allows a simple and quick fixing and replacement method of the printing heads 120 without any types of screw-fixing elements. The printing heads 120 could be quickly detached from the bracket 110 by a user, which greatly reduces the time consuming on the replacement of the cartridges 122, and the effectiveness of the present 3D printing apparatus 10 could be greatly improved in terms of the consumption of time and manpower.

Furthermore, in the present embodiment, different modeling materials such as clay or other suitable materials may be filled into the different printing heads 120. The pivot shaft 130 may be coupled to the control unit 160, therefore, the bracket 110 along with the printing heads 120 and wiper unit 140 are controlled by the control unit 160 for adjusting the rotating direction, rotating rates and the interval time between each of the printing process. Accordingly, a digital 3-D model could be read by the control unit 160 for executing the printing process. The digital 3-D model might include the rotating parameters of pivot shaft 130, the moving parameters of the printing head module 100, and the types of materials applied in different stages of the printing process.

Figure 4:
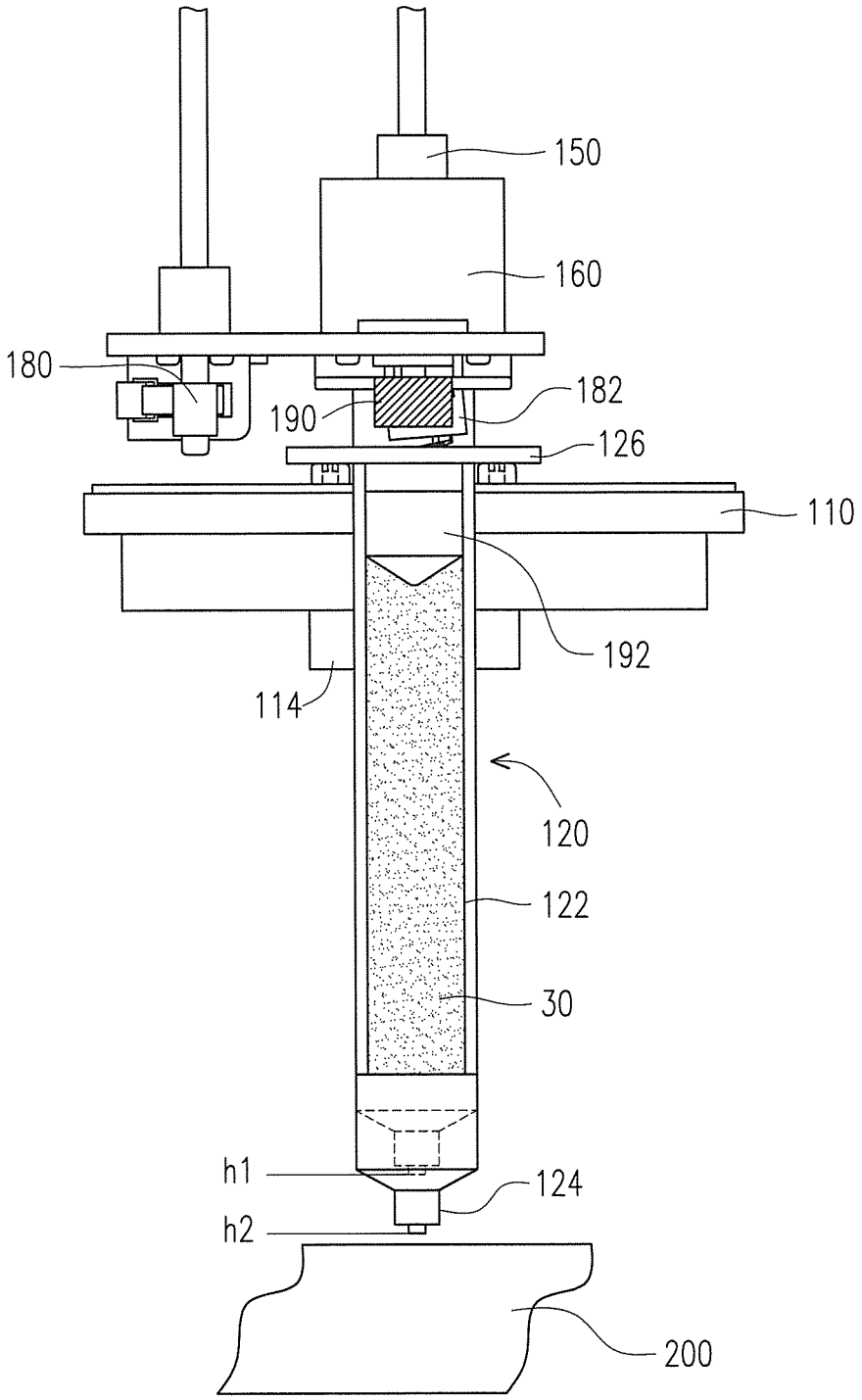
FIG. 4 is a partial perspective view of the printing head of the printing head module according to another exemplary embodiment.

FIG. 4 is a partial perspective view of one of the printing heads of the printing head module according to another exemplary embodiment. Referring to FIGS. 3 and 4, the control unit 160 may designate the printing time periods and dispensing amount of each of the printing heads 120 through controlling the pivot shaft 130, wiper unit 140, as well as the detecting information from several detecting units. The printing head 120 may be moved from the initial position h1 to the printing position h2 by the linear motor 150 as shown in FIG. 4, so the printing head 120 is passed through the opening 147 as shown in FIG. 1 and FIG. 2. At the time when the printing head 120 is moved to the printing position h2, the leaning portion 126 leans against the bracket 110. In the present embodiment, the printing head module 100 may further include a first detecting unit 180, and a second detecting unit 182 disposed corresponding to the target position L1. The printing head module 100 may further include a first piston 190 and a plurality of second pistons 192. The first piston 190 is disposed corresponding to the target position and connected to the linear motor 150. The second pistons 192 are slidably disposed in the cartridges 122 respectively for contacting the top surface of the modeling material 30 contained in the cartridges 122. In this way, the first and second detecting units 180, 182 may detect the movement of the first piston 190 and the second piston 192. The control unit 160 controls the linear motor 150 to drive the first piston 190 to push the printing head 120 moving from the initial position h1 to the printing position h2. Once the printing head 120 is moved to the printing position h2, the second detecting unit 182 is triggered to detect the position of the first piston 190. When the first piston 190 is continuously moved downward till it contacts the second piston 192, the second detecting unit 182 again detects the position of the first piston 190. The control unit 160 may then obtain the dispensing amount of the modeling material 30 according to the moving distance of the first piston 190. Accordingly, the information of dispensing or remaining amount of the modeling material 30 of the printing head 120 could be instantly known. In the present embodiment, the second detecting unit 182 could also be utilized to detect the position of the printing heads 120 to ensure the printing heads 120 move into the target position L1 for printing. Then, when the first piston 190 continuously pushes the second piston 192 to move toward the corresponding nozzle 124, the modeling material 30 is squeezed out for being dispensed on the base 200.

Furthermore, since the dispensing amount of the modeling material 30 could be obtained by the control unit 160, as the cartridge 122 of the printing head 120 in use is running out of the modeling material, the control unit 160 may drive pivot shaft 130 to rotate and switch the printing head 120 in use to the other printing heads 120. While the wiper unit 140 may be rotated along with the printing heads 120, the wiper 144 underneath the printing head 120 which has completed the printing process and pass by the target position L1 will restore to its block position P1 through the torsion component 145, and the wiper 144 underneath the printing head 120 rotating to the target position L1 for the following printing process will be constrained to the opening position P2 by the wiper opener 146.

In sum, the wiper unit of the printing head module is correspondingly disposed underneath the nozzle of the printing heads, so as to wipe off and collect the residual modeling material left on the tips of the nozzles of the printing heads not in use, in order to avoid the residual modeling material dropping from the nozzle of the printing head not in use during the printing process. Accordingly, the issues of material contamination during the 3-D printing process for the printing head module having multiple printing heads could be reduced. Therefore, the printing quality of the printing head module having multiple printing heads could be greatly enhanced without reducing its speed and effectiveness. Moreover, the wiper unit may further reduce the requiring effort in cleaning the nozzle tips and the maintenance of printing head module. Therefore, in a 3-D printing process, the interval time between the printing processes with different modeling materials could be minimized, which further enhance the efficiency and convenience of the printing head module of the 3-D printing apparatus.

Although the disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A printing head module, configured to dispense a modeling material layer by layer to form a three-dimensional object on a base, the printing head module comprising:

a bracket comprising a plurality of through holes;

a plurality of printing heads parallelly aligned with each other and disposed in the through holes respectively, each of the printing heads comprising a nozzle for extruding the modeling material;

a pivot shaft connected to the bracket to rotate one of the printing heads to a target position for dispensing the modeling material, the through holes disposed around the pivot shaft, such that the printing heads disposed therein surrounds the pivot shaft;

a wiper unit comprising:

a holder connected to the pivot shaft to be rotated with the bracket and the printing heads, the holder comprising a plurality of openings respectively located beneath and corresponding to the nozzles; and a plurality of wipers rotatably connected to the holder and disposed correspondingly to the openings, each of the wipers adapted to rotate between an open position for exposing the corresponding opening and a block position for covering the corresponding opening; and a wiper opener disposed at the target position to interfere with the wiper rotated to the target position, so as to drive the corresponding wiper to rotate to the opening position for the corresponding printing head to extrude the modeling material through the opening, the wiper opener releasing the interference when the corresponding wiper passes the target position, so the corresponding wiper rotate back to the blocking position to wipe off the residual modeling material from the tip of the nozzle.

2. The printing head module as claimed in claim 1, further comprising a control unit coupled to the pivot shaft for controlling the rotation of the bracket, so as to rotate one of the printing heads and the corresponding wiper to the target position.

3. The printing head module as claimed in claim 1, wherein the holder further comprises:

a plurality of carrying portions, disposed beneath and corresponding to the nozzles for carrying the wiped-off residual modeling material, and the openings disposed on the carrying portions respectively.

4. The printing head module as claimed in claim 1, wherein the wiper unit further comprises:

a plurality of torsion components for respectively connecting the wipers to the holder.

5. The printing head module as claimed in claim 4, wherein the torsion components comprise torsion springs.

6. The printing head module as claimed in claim 1, wherein each of the printing heads comprises a leaning portion and a cartridge connected to the corresponding nozzle for containing the modeling material, each of the printing heads is adapted to move between an initial position and a printing position, the leaning portion leaning against the bracket when the printing head located at the printing position.

7. The printing head module as claimed in claim 6, wherein when the printing head rotated to the target position is located at the printing position, the corresponding nozzle passes through the corresponding opening for extruding the modeling material through the corresponding opening.

8. The printing head module as claimed in claim 1, wherein each of the wipers further comprises an extension portion and a flat portion connected to the extension portion, the extension portion is adapted to interfere with the wiper opener, and the flat portion is adapted to wipe off and collect the residual modeling material from the tip of the nozzle.

9. The printing head module as claimed in claim 1, wherein the bracket further comprises a plurality of aligner holders for securing the printing heads on the bracket.

10. The printing head module as claimed in claim 1, wherein the modeling material comprises clay material.

* * * * *